US005839915A

United States Patent [19]

Ford et al.

[11] Patent Number: 5,839,915

[45] Date of Patent: Nov. 24, 1998

[54] LOCK DETECTING STRUCTURE OF CONNECTOR

[75] Inventors: Rhodri Ford, Hertfordshire, England; Masanori Tsuji, Shizuoka-ken, Japan

[73] Assignee: Yazaki Corporation, Tokyo, Japan

[21] Appl. No.: 816,999

[22] Filed: Mar. 14, 1997

Related U.S. Application Data

[63] Continuation of Ser. No. 435,035, May 5, 1995, abandoned.

[30] Foreign Application Priority Data

May 10, 1994 [JP] Japan ..... 6-096343

[51] Int. Cl.[6] ..... H01R 3/00

[52] U.S. Cl. ..... 439/489; 439/350

[58] Field of Search ..... 439/488, 489, 439/345, 347, 350–358

[56] References Cited

U.S. PATENT DOCUMENTS

| | | | |
|---|---|---|---|
| 5,120,255 | 6/1992 | Kouda et al. | 439/489 |
| 5,203,718 | 4/1993 | Chishima | 43/489 |
| 5,203,719 | 4/1993 | Kozono | 439/489 |

FOREIGN PATENT DOCUMENTS 4-147583 5/1992 Japan .

*Primary Examiner*—Hien Vu
*Attorney, Agent, or Firm*—Finnegan, Henderson, Farabow, Garrett & Dunner, L.L.P.

[57] ABSTRACT

A lock detection structure of a connector, includes: a first connector housing (63) having a connector lock projection (65); a second connector housing (39) having a deformable lock arm (49); and a lock detecting member (33, 83) for detecting whether the connector lock projection is locked with the deformable lock arm. The lock detecting member is composed of at least one deformable detection arm (69, 71; 87), at least one engage projection (77, 93) engaged with the deformable lock arm when the lock detecting member is engaged with the second connector housing, and at least one disengage projection (79, 95) formed also on the deformable detection arm (71, 87) at a position different from the at least one engage projection (77, 93) and dislocated from the deformable lock arm (49) by the connector lock projection (65) of the first connector housing (63) to disengage the engage projection (77, 93) from the deformable lock arm (49) when the first connector housing (63) is engaged with the second connector housing (39).

7 Claims, 8 Drawing Sheets

LOCK DETECTING STRUCTURE OF CONNECTOR

This application is a continuation of application Ser. No. 08/435,035 filed May 5, 1995, now abandoned.

BACKGROUND OF THE INVENTION

1. Technical Field

The present invention relates to a lock detection structure of a connector for detecting a locked condition of a pair of mated connector housings, and more specifically to the structure of the lock detecting member of the connector.

2. Description of the Related Art

An example of the connector having a lock detecting member is disclosed in Japanese Published Unexamined Patent Application No. 4-147583. This connector is composed of a male connector having a male connector housing, a female connector having a female connector housing to which the male connector housing is fitted, and a lock detecting member engaged with the male connector housing. In this connector, after the lock detecting member has been inserted into the male connector housing to engage an engage projection of the lock detecting member with an engage hole of the male connector housing, the female connector housing is engaged with the male connector housing. Here, if the female connector housing is perfectly mated with the male connector housing, since a lock projection of the female connector housing is engaged with the engage hole of the male connector housing, the engage projection of the lock detecting member already engaged with the engage hole of the male connector housing is disengaged (dislocated) from the engage hole of the male connector housing. Under these conditions, since the lock detecting member can be removed from the male connector housing, it is possible to detect that the male connector housing has been perfectly engaged and locked with the female connector housing. In other words, when the female connector is not engaged nor locked with the male connector perfectly, since the lock detecting member cannot be removed from the engage hole of the male connector housing, the perfect engagement of both the male and female connector housings can be detected.

In the conventional lock detecting member, however, when the male connector housing is mated with the female connector housing, since the engage projection of the lock detecting member must be perfectly replaced with the lock projection of the female connector housing in the engage hole of the male connector; that is, since the lock and lock detection between both the male and female connector housings are effected simultaneously, the dimension (height) of the lock projection of the female connector must be sufficiently large, so that a large locking force is required to lock both the male and female connector housings. In addition, since the engage projection of the lock detecting member is fairly deformed by the lock projection of the female connector, there exists a problem in that it is difficult to detect the locking conditions of both the male and female connectors securely and further the engage projection of the lock detecting member is easily worn off or damaged, with the result that the lock detecting member cannot be reused.

SUMMARY OF THE INVENTION

With these problems in mind therefore, it is the object of the present invention to provide a lock detection structure of a connector, which can detect the locking condition of the male and female connectors securely, without damaging the lock detecting member.

To achieve the above-mentioned object, the present invention provides a lock detection structure of a connector, including: a first connector housing (63) having a connector lock projection (65); a second connector housing (39) having a deformable lock arm (49) formed integral with the second connector housing; and a lock detecting member (33, 83) for detecting whether the connector lock projection of said first connector housing is locked with the deformable lock arm of said the second connector housing, said lock detecting member being formed with: at least one deformable detection arm (69, 71; 87); at least one engage projection (77, 93) formed on said deformable detection arm (69, 87) and engaged with the deformable lock arm of said second connector housing when said lock detecting member is engaged with said second connector housing; and at least one disengage projection (79, 95) formed also on said deformable detection arm (71, 87) at a position different from said at least one engage projection (77, 93) and dislocated from the deformable lock arm (49) by the connector lock projection (65) of said first connector housing (63) to disengage said engage projection (77, 93) from the deformable lock arm (49) when said first connector housing (63) is engaged with said second connector housing (39).

Further, the deformable lock arm (49) is formed with:

a pair of deformable arms (51) formed integral with said second connector housing (39); and an intermediate lock projection (55) formed by bridging said two deformable arms at a middle portion thereof and engaged with the connector lock projection (65) of said first connector housing (63).

Further, the locking direction between said first and second connector housings (63, 39) is different from engage direction between said second connector housing (39) and said lock detecting member (33).

Further, in the first aspect of the present invention, the lock detecting member (33) is formed with a pair of opposing deformable detection arms (69) having said two engage projections (77) at each free end thereof respectively, a support plate (71) having said disengage projection (79) thereon; said two engage projections (77) are engaged with two engage cutouts (59) formed on side surfaces of a pair of the deformable arms (51) of said second connector housing (39), and further said disengage projection (79) is engaged with an engage hole (57) formed between the two deformable arms (51), when said lock detecting member is engaged with said second connector housing; and said connector lock projection (65) deforms the support plate (71) via the disengage projection (79) from above, to disengage said two engage projections (77) from the engage cutouts (59) of the two deformable arms (51), when said first connector housing is securely engaged with said second connector housing.

Further, in the second aspect of the present invention, the lock detecting member (83) is formed with a deformable detection arm (87) having said engage projection (93) at a free end thereof and said disengage projections (95) at an intermediate portion thereof; said engage projection (93) is engaged with the intermediate lock projection (55) of said second connector housing (39) and further said disengage projections (95) are engaged with the engage hole (57) formed between the two deformable arms (51) of said second connector housing, when said lock detecting member is engaged with the second connector housing; and said connector lock projection (65) deforms the deformable detection arm (87) via the disengageprojection (95) from above, to disengage said engage projection (93) from the intermediate lock projection (55) of said second housing (39) when said first connector housing is securely engaged with said second connector housing.

In the lock detection structure of the connector according to the present invention, since the disengage projection (79, 95) shifted by the first connector housing is provided at a position different from the engage projection (77, 93) for engaging the lock detecting member with the second connector housing, it is possible to reduce the height of the female connector lock projection (65) of the first connector housing (63), so that the force applied to the disengage projection (79, 95) of the lock detecting member can be reduced, thus preventing the lock detecting member from being damaged.

Further, since the lock detecting member is depressed by depressing the disengage projection (79, 95) by the intermediate lock projection (55) of the second connector housing indirectly; that is, since a large force is not applied directly to the disengage projection (79, 95), it is possible to prevent the lock detecting member from being damaged, so that the lock detecting member can be used again.

Further, since the engagement direction between the two connector housings is different from the engagement direction between the lock detecting member and the second connector housing, it is possible to freely adjust the deformation rate of the deformable detection arm (69, 87) of the lock detecting member.

BRIEF DESCRIPTION OF THE DRAWINGS

FIG. 2(*b*) is a cross-sectional perspective view taken along the line 2B—2B in FIG. 2(*a*);

FIG. 2(*c*) is a cross-sectional perspective view taken along the line 2C—2C in FIG. 2(*a*);

FIG. 3(*b*) is a cross-sectional perspective view showing a state in which the male connector has been mated with the female connector and the lock detecting member is being removed from the male connector housing in the first embodiment shown in FIG. 1;

FIG. 3(*c*) is a cross-sectional perspective view showing a state in which the male connector has been mated with the female connector perfectly so that the lock detecting member is disengaged from the male connector housing in the first embodiment shown in FIG. 1;

FIG. 3(*d*) is a cross-sectional perspective view showing a state in which the male connector has been mated with the female connector and the lock detecting member is being removed from the male connector housing in the first embodiment shown in FIG. 1;

FIG. 5(*b*) is a cross-section view showing the same state shown in FIG. 5(*a*);

FIG. 6(*b*) is a cross-section view showing the same state shown in FIG. 6(*a*);

FIG. 7(*b*) is a cross-section view showing the same state shown in FIG. 7(*a*).

DETAILED DESCRIPTION OF THE EMBODIMENTS

Embodiments of the lock detection structure of the connector according to the present invention will be described hereinbelow with reference to the attached drawings.

[First embodiment]

Figure 1:
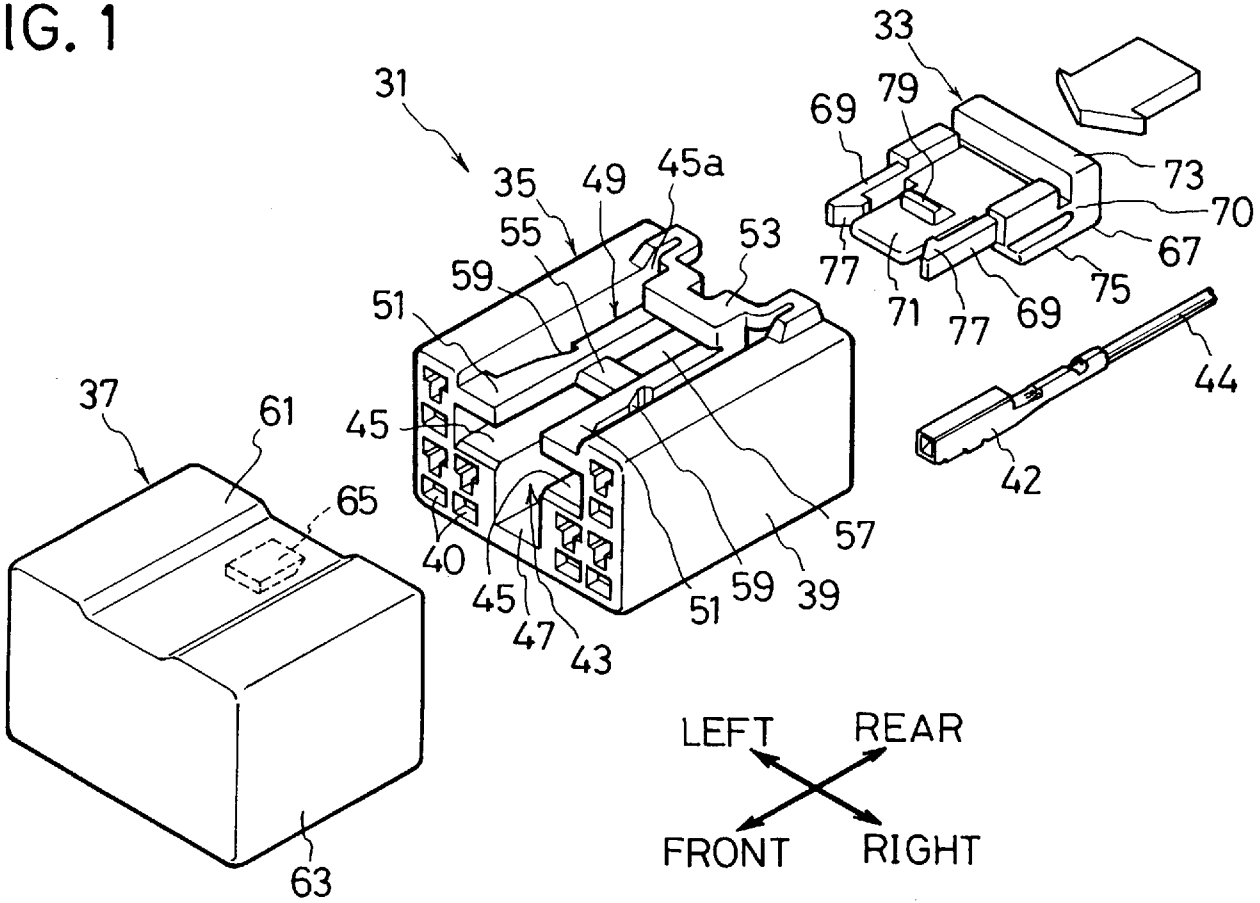
FIG. 1 is a perspective view showing a first embodiment of the connector having a lock detecting member according to the present invention.

A first embodiment will be described with reference to FIGS. 1 to 3(*d*). As shown in FIG. 1, a connector 31 with lock detection structure according to the present invention comprises a male connector 35, a female connector 37, and a lock detecting member 33.

The male connector 35 is roughly composed of a male connector housing 39 and a deformable lock arm 49. The male connector housing 39 is formed with a plurality of terminal accommodating chambers 40 for accommodating a plurality of female terminals 42. A wire 44 clamped to each of the female terminals 42 is taken out from the rear end portion of the male connector housing 39. Further, the male connector housing 39 is formed with a T-shaped groove 43 extending in the front and rear direction of the male connector housing 39, which is composed of a narrow lower guide groove 47 and two wide middle guide grooves 45. Over the T-shaped groove 43, a deformable lock arm 49 is formed.

The deformable lock arm 49 is composed of a pair of deformable arms 51 extending in the front and rear direction of the middle guide grooves 45, and an elastic support portion 53 connected between two free ends (the rear end portions) of the deformable arms 51 and two inner walls 45*a* of the rear end portion of the middle guide grooves 45. Further, an intermediate lock projection 55 is bridged between the two deformable arms 51 at the middle portion thereof in such a way as to form an engage hole 57 between the intermediate lock projection 55 and the elastic support portion 53. In addition, an engage cutout 59 is formed in an inner side surface of each of the deformable arms 51 so as to face the inner wall of the middle guide groove 45.

On the other hand, the female connector 37 has a hood portion 61 formed integral with a female connector housing 63, into which the male connector housing 39 is inserted. A plurality of male connector terminals 60 (See FIG. 3(*a*)) are arranged within the female connector housing 63. Therefore, when the male connector 35 is mated with the female connector 37, these male connector terminals 60 arranged in the female connector housing 63 are electrically connected to the female connector terminals 42 arranged in the male connector housing 39. In addition, a female connector lock projection 65 is formed in an inner wall of the engage hood 61 of the female connector 37 so as to be engaged with the intermediate lock projection 55 of the deformable lock arm 49 of the male connector 35.

The lock detecting member 33 is inserted into the male connector housing 39 of the male connector 35 to detect whether the male and female connectors have been perfectly locked with each other. The lock detecting member 33 is composed of a detection body 67, a pair of deformable detection arms 69, and a support plate (a sort of deformable detection arm) 71. The deformable detection arms 69 are formed integral with the detection body 67. The support plate 71 is formed between the two deformable detection arms 69 and also formed integral with the detection body 67. Further, the detection body 67 is formed with a stopper wall portion 73, a guide plate 75 extending from the stopper wall portion 73 roughly perpendicular thereto. The guide plate 75 is a guide rib 75*a* thin on both sides thereof (in the right and left direction thereof) and thick at the middle portion thereof. When the lock detecting member 33 is inserted into the male connector housing 39, the guide rib 75*a* is inserted into the guide groove 47 of the male connector housing 39 (as shown in FIG. 2(*b*)), and the stopper wall portion 73 is brought into contact with the rear side surface of the elastic support portion 53 of the deformable lock arm 49.

Each of the deformable detection arms 69 is formed with an engage projection 77 extending inward at each free end thereof. When the lock detection member 33 is inserted into the male connector housing 39, these engage portions 77 are engaged with the engage cutouts 59 formed in the deformable arms 51 of the deformable lock arm 49. In more detail, when each of the two deformable detection arms 69 is inserted into a space formed between the inner wall of the middle guide groove 45 and the deformable arm 51 of the male connector housing 39, the engage projections 77 of the lock detecting member 33 are engaged with the engage cutouts 59 of the deformable arms 51 of the male connector housing 39, respectively.

Further, a disengage projection 79 is formed on the upper surface of the support plate 71 and between the two engage projections 77 and the stopper wall portion 73. When the lock detecting member 33 is inserted into the male connector housing 39, this disengage projection 79 is engaged with the engage hole 57 formed in the male connector housing 39 in contact with the intermediate lock projection 55. Under these conditions, it should be noted that the engaging direction of relative movement between the female connector lock projection 65 and the intermediate lock projection 55 of the male connector housing 39 is perpendicular to the locking direction of relative movement between the engage projections 77 of the lock detecting member 33 and the engage cutouts 59 of the deformable lock arm 49 of the male connector housing 39. When the male connector housing 39 is mated with the female connector housing 63, since the disengage projection 79 is depressed by the female connector lock projection 65, the support plate 71 is deformed downward toward the guide plate 75 as shown in FIGS. 3(*a*) and (*b*), so that the two deformable detection arms 69 are deformed downward. As a result, since the engage projections 77 of the deformable detection arms 69 can be disengaged from the engage cutouts 59 of the deformable lock arm 49 of the male connector housing 39, the lock detecting member 33 can be removed from the male connector housing 39.

The engagement procedure of the male connector 35, the female connector 37, and the lock detecting member 33 will be described hereinbelow.

Figure 2A:
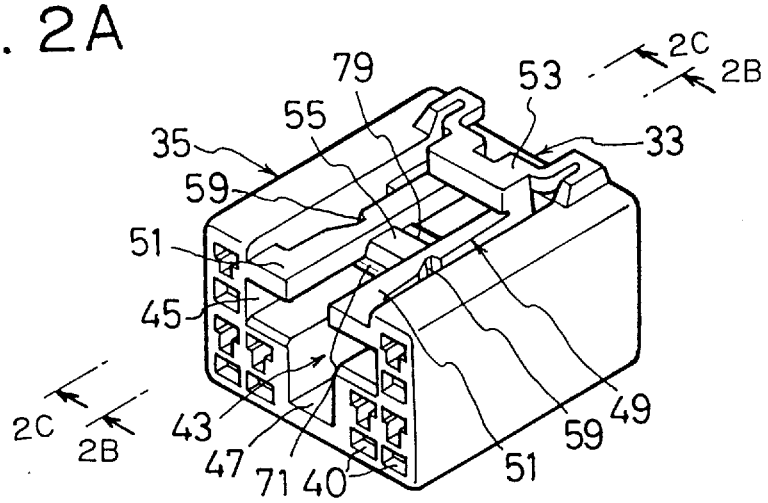
FIG. 2(*a*) is a perspective view showing the male connector housing with which the lock detecting member is engaged in the first embodiment shown in FIG. 1.
Figure 2B:
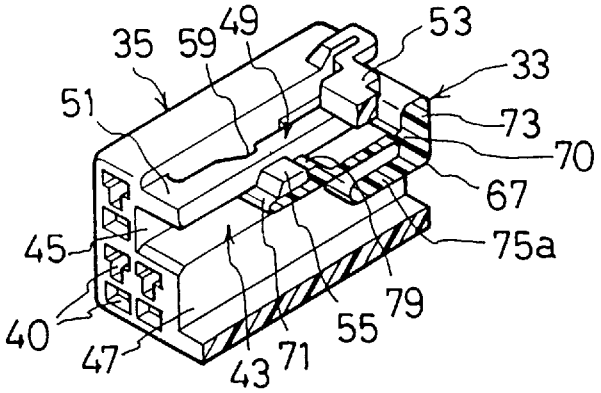
Figure 2C:
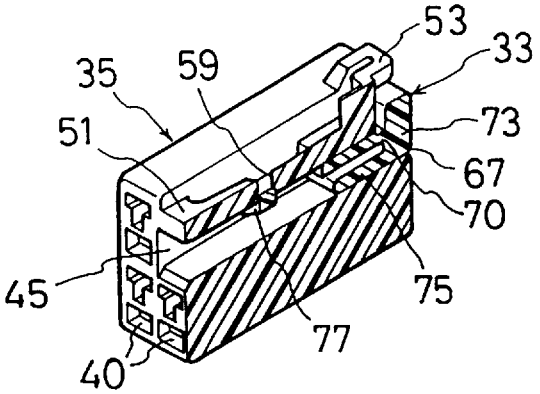
Figure 3A:
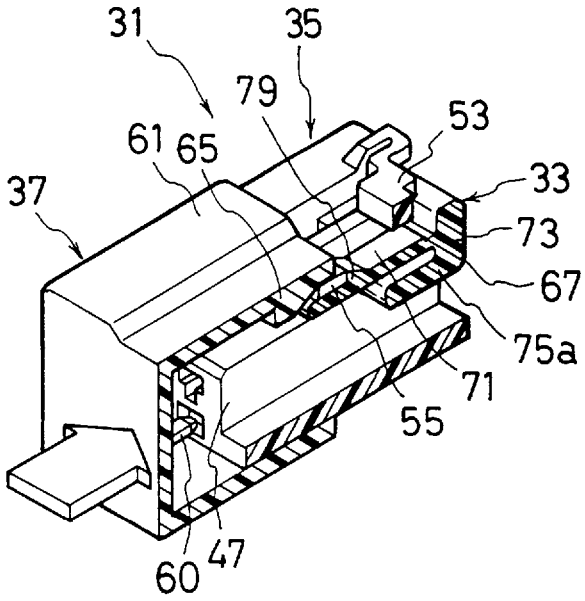
FIG. 3(*a*) is a cross-sectional perspective view showing a state in which the male connector is being mated with the female connector in the first embodiment shown in FIG. 1.
Figure 3B:
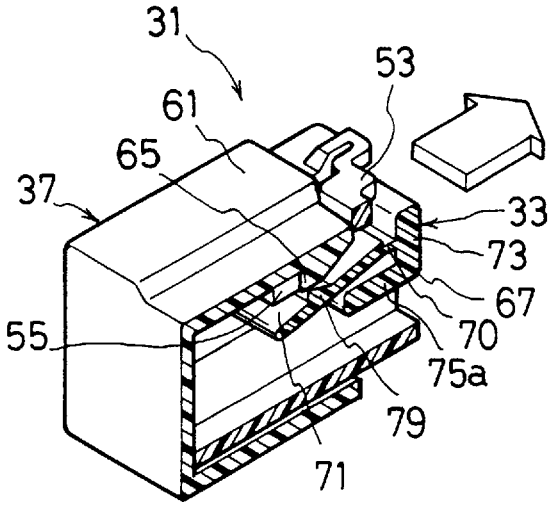
Figure 3C:
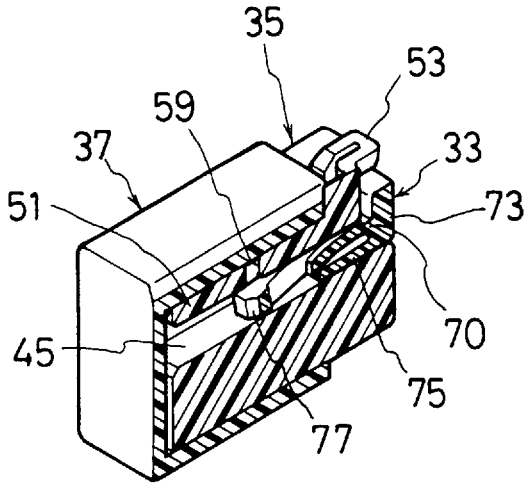
Figure 3D:
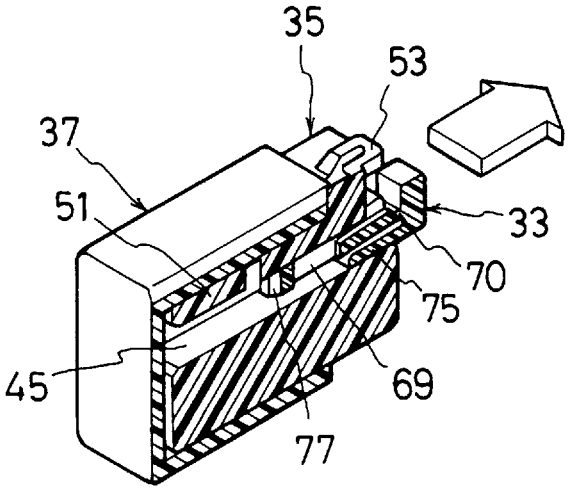
Figure 4:
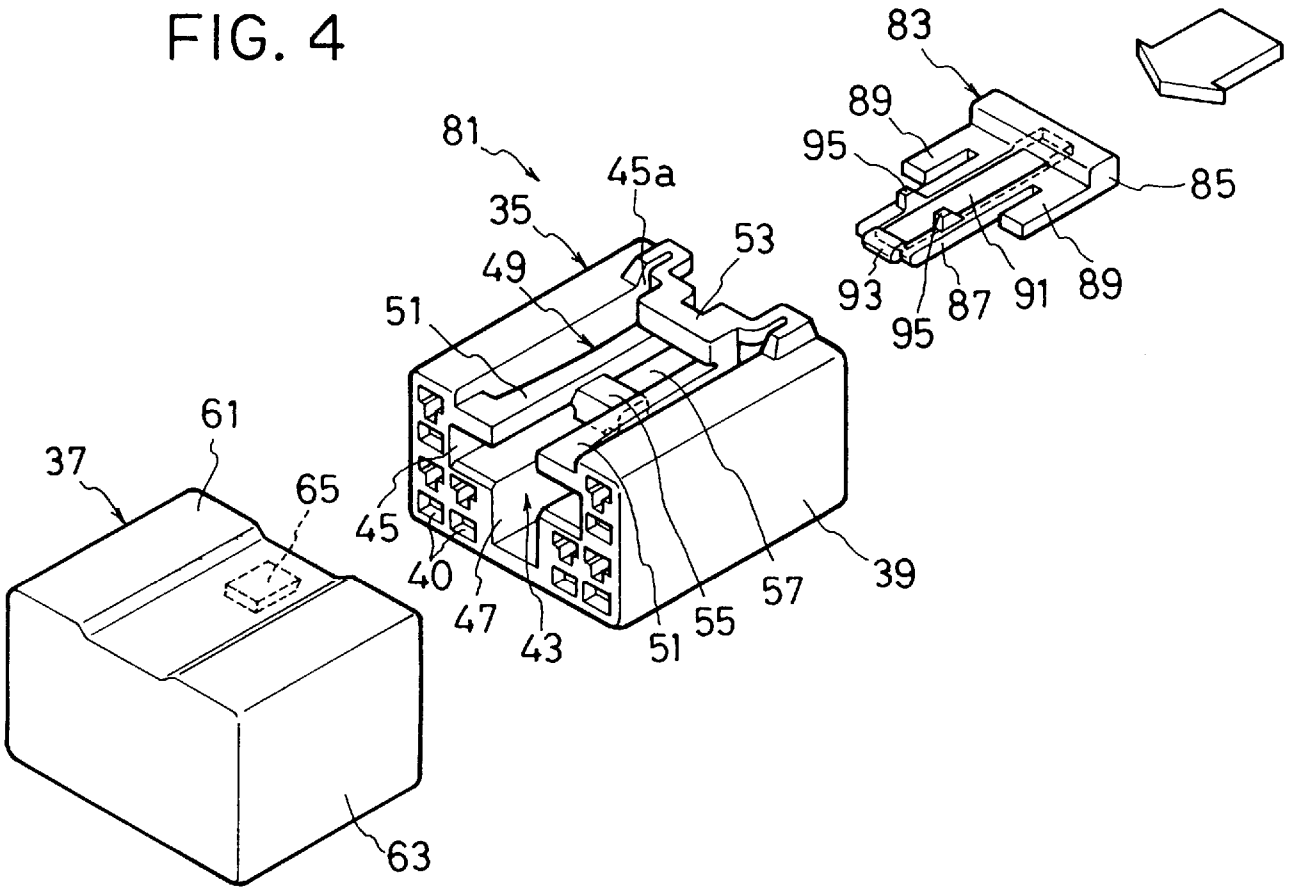
FIG. 4 is a perspective view showing a second embodiment of the connector having a lock detecting member according to the present invention.

As shown in FIGS. 2(*a*) to (*c*), the lock detecting member 33 is inserted into the male connector housing 39. In more detail, the guide rib 75*a* of the lock detecting member 33 is inserted into the guide grooves 45 of the male connector housing 39 and further the deformable detection arms 69 are inserted into the spaces between the inner walls of the guide grooves 45 and the deformable arms 51 of the deformable lock arm 49. Under these conditions, the lock detecting member 33 is inserted into the T-shaped groove 43 of the male connector housing 39; the engage projections 77 of the deformable detection arms 69 of the lock detecting member 33 are engaged with the engage cutouts 59 of the deformable lock arm 49 of the male connector housing 39; and in addition the disengage projection 79 of the lock detecting member 33 is engaged with the engage hole 57 of the male connector housing 39 and further brought into contact with the rear end portion of the intermediate lock projection 55 of the male connector housing 39.

Under these conditions, when the male connector 35 is inserted into the engage hood 61 of the female connector 37 as shown in FIG. 3(*a*), since the female connector lock projection 65 formed in an inner wall of the engage hood 61 of the female connector housing 63 is brought into contact with the front end surface of the intermediate lock projection 55 of the male connector housing 39, the deformable lock arm 49 of the male connector 35 is deformed downward, so that the support plate 71 of the lock detecting member 33 is also deformed downward. When the female connector lock projection 65 overrides the intermediate lock projection 55 as shown in FIG. 3(*b*), since the female connector lock projection 65 is in contact with the upper surface of the disengage projection 79 of the lock detecting member 33, the disengage projection 79 is disengaged from the engage hole 57 of the male connector housing 35, so that the engage projections 77 of the lock detecting member 33 are also disengaged from the engage cutouts 59 of the male connector housing 39, as shown in FIG. 3(*c*). Under these conditions, since the lock detecting member 33 can be removed from the male connector housing 39, it is possible to detect that the female connector lock projection 65 of the female connector housing 63 is perfectly engaged with the engage hole 57 of the male connector housing 39; that is, the female connector 37 has been perfectly mated with the male connector 35.

In this connection, when the male connector 35 is not perfectly inserted into the engage hood 61 of the female connector 37, since the female connector lock projection 65 will not override the intermediate lock projection 55 of the male connector housing 35; in other words, since the engage projections 77 of the lock detecting member 33 will not be disengaged from the engage cutouts 59 of the deformable lock arm 49 of the male connector housing 35, it is impossible to remove the lock detecting member 33 from the male connector housing 39, so that it is possible to detect the state where the male connector 35 is half engaged with the female connector 37 imperfectly.

In the first embodiment of the lock detection structure of the connector according to the present invention, since the disengage projection 79 (which detects the lock conditions between the two connector housings 63 and 39) is provided at a position different from the engage projections 77 (which do not detect the lock conditions between the two), it is possible to reduce the height of the female connector lock projection 65 of the female connector housing 63, so that the force applied to the disengage projection 79 of the lock detecting member 33 can be reduced, thus preventing the lock detecting member 33 from being damaged.

Further, since the lock detecting member 33 is depressed by depressing the disengage projection 79 by the intermediate lock projection 55 of the male connector housing 39 indirectly; that is, since a large force is not applied directly to the disengage projection 79, it is possible to prevent the lock detecting member 33 from being damaged, so that the lock detecting member 33 can be used again.

Further, since the engagement direction between the male and female connector housings 63 and 39 is different from the engagement direction between the lock detecting member 33 and the male connector housing 39, it is possible to freely adjust the deformation rate of the deformable detection arms 69 of the lock detecting member 33.

Further, since lock detecting member 33 is provided with guide rib 75*a*, it is possible to prevent the lock detecting member 33 from being inserted into the connector housing 39 upsidedown.

[Second embodiment]

The second embodiment of the connector according to the present invention will be described hereinbelow with reference to FIGS. 4 to 7(*b*), in which the same reference numerals have been retained for the similar elements or parts which have the same functions as with the case of the first embodiment, without repeating the similar description thereof.

In this second embodiment, the deformable arms 51 of the deformable lock arm 49 of the male connector housing 39 have no engage cutouts 59, and the lock detecting member 83 is different in structure from that of the first embodiment.

The deformable detecting arm 87 is composed of a detection body 85 and a single deformable detection arm 87 formed integral with the detection body 85. Two short guide plates 89 are formed on both sides of the deformable detection arm 87 so as to be inserted into the guide grooves 45 of the male connector housing 35. A thin-wall portion 91 is formed at the middle portion of the deformable detection arm 87, and an engage projection 93 is formed at the free end of the deformable detection arm 87 so as to extend upward. This engage projection 93 is engaged with the front end surface of the intermediate lock projection 55 of the male connector housing 39 to hold the lock detecting member 83 by the male connector housing 39. Further, a pair of disengage projections 95 are formed on both sides of the thin-wall portion 91 so as to be engaged with the engage hole 57 and brought into contact with the rear end surfaces of the intermediate lock projection 55 of the male connector housing 39 when the lock detecting member 83 is inserted into the male connector housing 39.

The engagement procedure of the male connector housing 39, the female connector housing 37 and the lock detecting member 83 will be described hereinbelow.

Figure 5A:
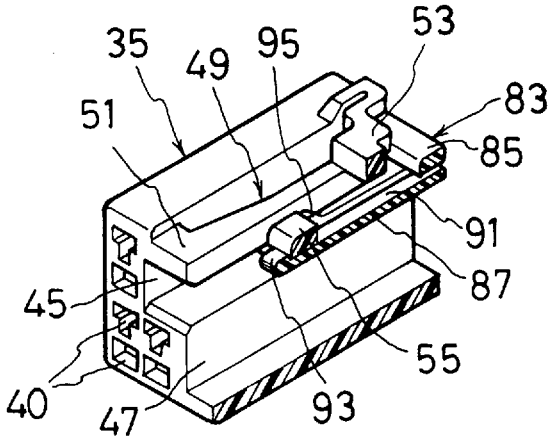
FIG. 5(*a*) is a cross-sectional perspective view showing a state in which the lock detecting member is engaged with the male connector in the second embodiment shown in FIG. 4.
Figure 5B:
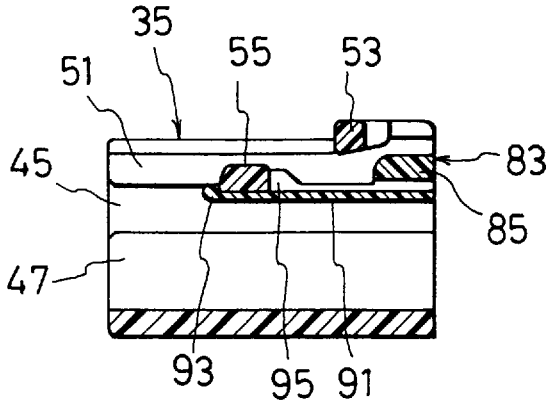

First, the lock detecting member 83 is engaged with the male connector housing 39. In more detail, the two guide plates 89 are inserted into the middle guide grooves 45, and further the deformable detection arm 87 is inserted under the deformable lock arm 49. When the lock detecting member 83 is inserted into the T-shaped groove 43 of the male connector housing 39, as shown in FIGS. 5(*a*) and (*b*), the engage projection 93 is engaged with the front end surface of the intermediate lock projection 55, and further the disengage projections 95 are engaged with the engage hole 57 (the rear end surface of the intermediate lock projection 55) of the male connector housing 39.

Figure 6A:
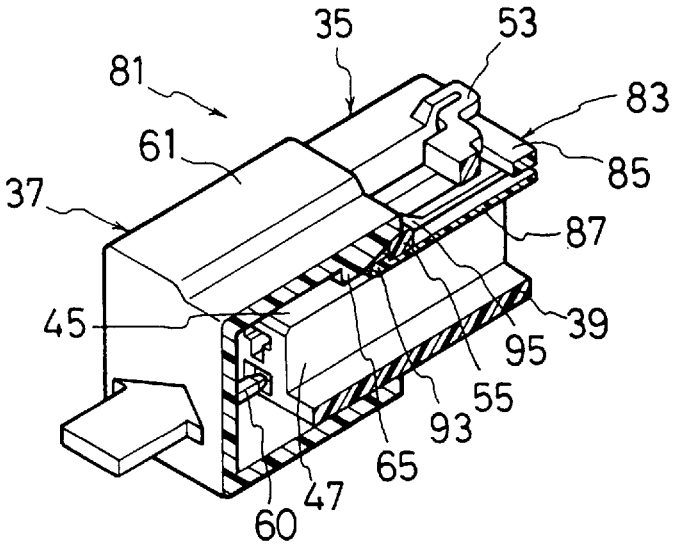
FIG. 6(*a*) is a cross-sectional perspective view showing a state in which the male connector is engaged with the female connector in the second embodiment shown in FIG. 4.
Figure 6B:
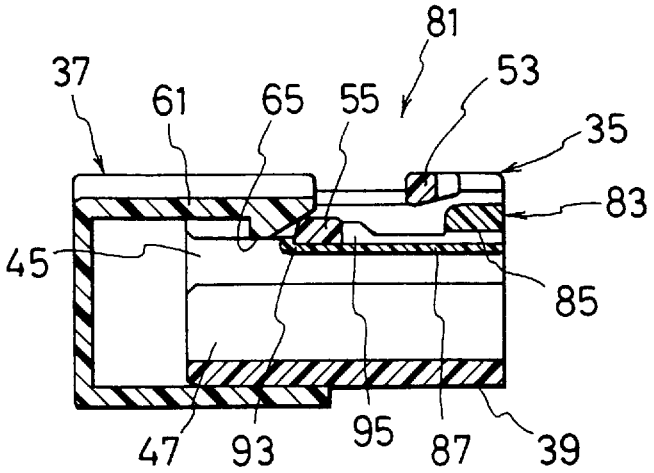
Figure 7A:
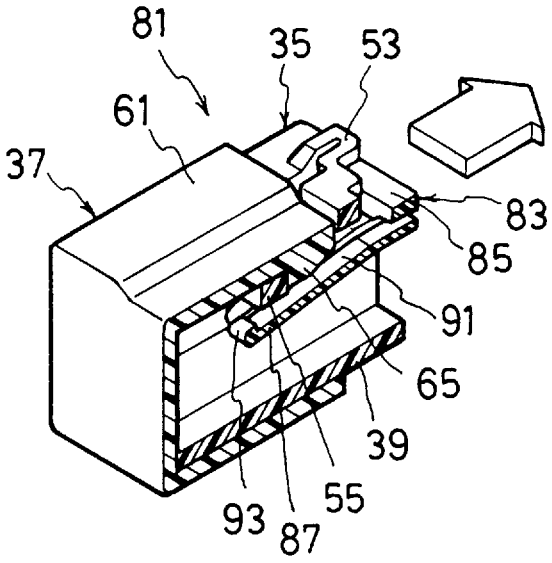
FIG. 7(*a*) is a cross-sectional perspective view showing a state in which the male connector has been perfectly engaged with the female connector so that the lock detecting member can be removed from the male connector housing in the second embodiment shown in FIG. 4.
Figure 7B:
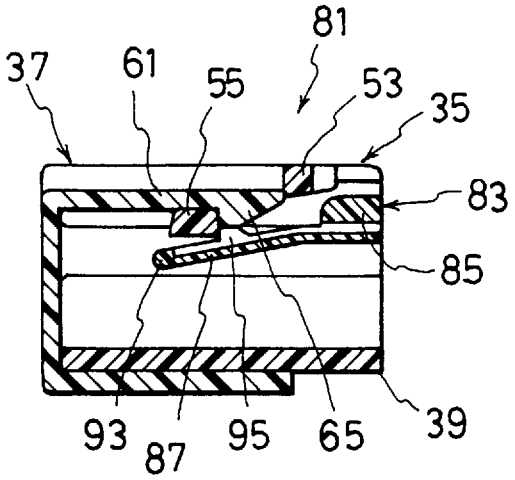

Under these conditions, when the male connector 35 is inserted into the engage hood portion 61 of the female connector 37, as shown in FIG. 6(*a*) and (*b*), since the female connector lock projection 65 formed in the inner wall of the female connector housing 63 is brought into contact with the intermediate lock projection 55 of the male connector housing 35, the deformable lock arm 49 is deformed downward, so that the deformable detection arm 87 is also deformed downward. Further, when the female connector lock projection 65 overrides the intermediate lock projection 55 as shown in FIGS. 7(*a*) and (*b*), since the female connector lock projection 65 is engaged with the rear end portion of the intermediate lock projection 55 and further brought into contact with the upper surface of the disengage projections 95, the disengage projections 95 are disengaged from the engage hole 57 of the male connector housing 39. As a result, the deformable detection arm 87 is kept deformed downward, so that the engage projection 93 is disengaged from the front end surface of the intermediate lock projection 55. Under these conditions, since the lock detecting member 83 can be removed from the male connector housing 39, it is possible to detect that the female connector lock projection 65 of the female connector housing 63 is engaged with the engage hole 57 of the male connector housing 39; that is, the female connector 37 has been perfectly mated with the male connector 35.

In this connection, when the male connector 35 is not perfectly inserted into the engage hood 61 of the female connector 37, since the female connector lock projection 65 will not override the intermediate lock projection 55 of the male connector housing 35; in other words, since the engage projection 93 will not be disengaged from the engage hole 57 or the intermediate lock projection 55 of the male connector housing 35, it is impossible to remove the lock detecting member 83 from the male connector housing 39, so that it is possible to detect the state where the male connector 35 is half engaged with the female connector 37 imperfectly.

Further, in this second embodiment, the disengage projections 95 can be used as the guides when the lock detecting member 83 is inserted into the male connector housing 39.

In the second embodiment of the connector according to the present invention, since the disengage projections 95 (which detect the lock condition between the two connector housings 63 and 39) are provided at a position different from the engage projection 93 (which do not detect the lock condition between the two), it is possible to reduce the height of the female connector lock projection 65 of the female connector housing 63, so that the force applied to the disengage projections 95 can be reduced, thus preventing the lock detecting member 83 from being damaged.

Further, since the lock detecting member 83 is depressed by depressing the disengage projections 95 by the intermediate lock projection 55 indirectly; that is, since a large force is not applied directly to the disengage projections 95, it is possible to prevent the lock detecting member 83 from being damaged, so that the lock detecting member 83 can be used again.

As described above, in the present invention, since the disengage projection shifted by the first connector housing is provided at a position different from the engage projection for engaging the lock detecting member with the second connector housing, it is possible to reduce the height of the female connector lock projection of the first connector housing, so that the force applied to the disengage projection of the lock detecting member can be reduced, thus preventing the lock detecting member from being damaged.

Further, since the lock detecting member is depressed by depressing the disengage projection by the intermediate lock projection of the second connector housing indirectly; that is, since a large force is not applied directly to the disengage projection, it is possible to prevent the lock detecting member from being damaged, so that the lock detecting member can be used again.

Further, since the engagement direction between the two connector housings is different from the engagement direction between the lock detecting member and the second connector housing, it is possible to freely adjust the deformation rate of the deformable detection arm of the lock detecting member.

What is claimed is:

1. An electrical connector assembly comprising:

a first connector housing having a connector lock projection;

a second connector housing having a deformable lock arm integral with the second connector housing; and a lock detecting member for detecting whether the connector lock projection of the first connector housing is lockingly engaging an intermediate lock projection on of the deformable lock arm of the second connector housing, the lock detecting member including:

at least one deformable detection arm, an engage projection on the deformable detection arm, the engage projection engaging a latching portion of the deformable lock arm of the second connector housing while the lock detecting member is inserted in the second connector housing, and a deformable support plate joined with the deformable detection arm and carrying a disengage projection in spaced relation to the engage projection, the disengage projection pushed by the connector lock projection of the first connector housing to deform the deformable detection arm and thereby disengage the engage projection from the latching portion of the deformable lock arm when the first connector housing and the second connector housing are mated with the connector lock projection lockingly engaging intermediate lock projection on the deformable lock arm, thereby permitting withdrawal of the lock detecting member from the second connector housing.

2. The electrical connector assembly of claim 1, wherein the deformable lock arm includes:

a pair of resilient arms integral with the second connector housing, and the intermediate lock projection on the deformable lock arm bridging the resilient arms at an intermediate position to lockingly engage the connector lock projection when the first connector housing and the second connector housing are fully mated.

3. The electrical connector assembly of claim 1, wherein a direction of relative movement of the connector lock projection and the intermediate lock projection on the deformable lock arm into locking engagement differs from a direction of relative movement of the engage projection on the deformable detection arm and the latching portion of the deformable lock arm into engaged relation.

4. The electrical connector assembly of claim 2, wherein:

the lock detecting member includes a pair of parallel, deformable detection arms, each having one engage projection at a free end, the support plate positioned between the deformable detection arms, and the engage projections engaging the latching portion of the deformable lock arm provided as cutouts in side surfaces of the resilient arms, and the disengage projection residing in an opening between the resilient arms when the lock detecting member is inserted into the second connector housing, wherein the connector lock projection deforms the support plate via the disengage projection to disengage the engage projections from the cutouts when the first connector housing and the second connector housing are fully mated.

5. An electrical connector assembly comprising:

a first connector housing having a connector lock projection;

a second connector housing having a deformable lock arm integral with the second connector housing; and a lock detecting member for detecting whether the connector lock projection of the first connector housing is lockingly engaging an intermediate lock projection of the deformable lock arm of the second connector housing while the lock detecting member is inserted in the second detector housing, the lock detecting member including:

a deformable detection arm, an engage projection carried at a free end of the deformable detection arm to engage the intermediate lock projection of the deformable lock arm of the second connector housing when the detection member is inserted into the second connector housing, and at least one disengage projection carried on the deformable detection arm in spaced relation to the engage projection, the disengage projection pushed by the connector lock projection of the first connector housing to deform the deformable detection arm and thereby disengage the engage projection from the intermediate lock projection of the deformable lock arm when the first connector housing and the second connector housing are mated with the connector lock projection lockingly engaging the intermediate lock projection on the deformable lock arm, thereby permitting withdrawal of the lock detecting member form the second connector housing.

6. The electrical connector assembly of claim 5, wherein the deformable lock arm includes a pair of resilient arms bridged by the intermediate lock projection.

7. The electrical connector assembly of claim 6, wherein, when the lock detection member is inserted in the second connector housing, the disengage projection resides in an opening between the resilient arms of the deformable lock arm adjacent a first side edge of the intermediate lock projection and the engage projection on the deformable detection arm latchingly engages a second side edge of the intermediate lock projection, and, when the first and second connector housings are fully mated, the connector lock projection lockingly engages the first side edge of the intermediate lock projection.

* * * * *

UNITED STATES PATENT AND TRADEMARK OFFICE

CERTIFICATE OF CORRECTION

PATENT NO. : 5,839,915
DATED : November 24, 1998
INVENTOR(S) : FORD et al.

It is certified that error appears in the above-identified patent and that said Letters Patent is hereby corrected as shown below:

Claim 1, column 9, line 14, before "deformable", delete "of".

Claim 5, column 10, line 43, "form" should read --from--.

Signed and Sealed this

Ninth Day of November, 1999

*Attest:*

*Attesting Officer*

Q. TODD DICKINSON

*Acting Commissioner of Patents and Trademarks*